US005964014A

United States Patent [19]

Wang et al.

[11] Patent Number: 5,964,014

[45] Date of Patent: Oct. 12, 1999

[54] STRUCTURE OF AN ENVIRONMENTAL FRIENDLY COFFIN

[76] Inventors: Sheng Ming Wang; Yi-Jen Wang, both of P.O. Box 82-144, Taipei, Taiwan

[21] Appl. No.: 09/121,538

[22] Filed: Jul. 24, 1998

[51] Int. Cl.[6] ..... A61G 17/00

[52] U.S. Cl. ..... 27/2; 27/10

[58] Field of Search ..... 27/2, 3, 4, 7, 10, 27/14, 35

[56] References Cited

U.S. PATENT DOCUMENTS

| | | | |
|---|---|---|---|
| 1,989,962 | 2/1935 | Zinser et al. | 27/7 X |
| 2,030,588 | 2/1936 | Hedeen et al. | 27/35 |
| 3,025,624 | 3/1962 | Harrell | 27/10 X |
| 3,879,818 | 4/1975 | Rowland | 27/10 X |
| 4,372,018 | 2/1983 | Miller, IV at al. | 27/35 |
| 5,771,548 | 6/1998 | Jenkins | 27/4 X |
| 5,813,100 | 9/1998 | Mackirdy | 27/10 X |
| 5,815,898 | 10/1998 | Jenkins | 27/4 |

*Primary Examiner*—Brian K. Green
*Assistant Examiner*—William L. Miller
*Attorney, Agent, or Firm*—A & J

[57] ABSTRACT

An improved structure of an environmental friendly coffin including a lid, faceplates, a U-shaped coffin body, and a reinforcing bottom board made from kraft boards formed by adhering multiple layers of kraft together and applying thermal pressure thereto. Wooden frames are fixed to the four sides of the coffin to reinforce the pressure-resistance and shear-resistance of the coffin. Both the manufacturing cost and timber material can be greatly reduced. Besides, burning of the coffin will not cause environmental pollution.

1 Claim, 5 Drawing Sheets

STRUCTURE OF AN ENVIRONMENTAL FRIENDLY COFFIN

BACKGROUND OF THE INVENTION

1. Field of the Invention

The present invention is generally related to an coffin structure, and more particularly to an improved structure of an environmental friendly coffin which is not only inexpensive to manufacture but also reduces the timber material used.

2. Description of the Prior Art

Coffins are generally made of wood so that they are very heavy. Added by the weight of the dead, a coffin is so heavy that it requires six people to lift or carry it. If the dead is to be interred instead of being cremated, the undertakers or relatives/friends may even have to carry the heavy coffin over hills. Besides, as coffins are made of timber, they are very expensive.

Furthermore, seen from the perspective of environmental protection, conventional wooden coffins have drawbacks. Coffins are usually coated with a paint to the paint (containing lead) will react with the soil and intoxicate it. In cremation, although the metal parts and fittings on the coffin will be removed, the burning of the coffin will produce toxic gases that pollute the environment. In addition, the paint on the coffin will damage the remains of the dead or makes it inconvenient to collect the remains.

SUMMARY OF THE INVENTION

The present invention is generally related to an coffin structure, and more particularly to an improved structure of an environmental friendly coffin which is not only inexpensive to manufacture but also reduces the timber material used.

A primary object of the present invention is to provide an improved structure of an environmental friendly coffin which is inexpensive tomanufacture and uses reduced timber material. According to the present invention, multiple layers of tough kraft are adhered together and thermal-pressed to form kraft boards of a considerable thickness and pressure-resistance. In general, eighteen layers of kraft may be pressed to form a kraft board of 7 mm capable of bearing a weight of about 200 kilograms. Use of such kraft boards to form the coffin of the present invention can achieve a coffin of approximately 48 kilograms, which is much lighter than conventional coffins. Sugar can boards are used to form front and rear faceplates with decorative or religious symbols, patterns or words. The coffin is coated with an environmental friendly banana oil of different colors. The coffin, when burnt, does not produce black smoke and can be consumed in fire in a relatively short time. A water-resistance PE sheet adhered to a felt sheet spread on the bottom side of the coffin combined with a double-layer bottom frame enable the coffin to be kept for a relatively long mourning period.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
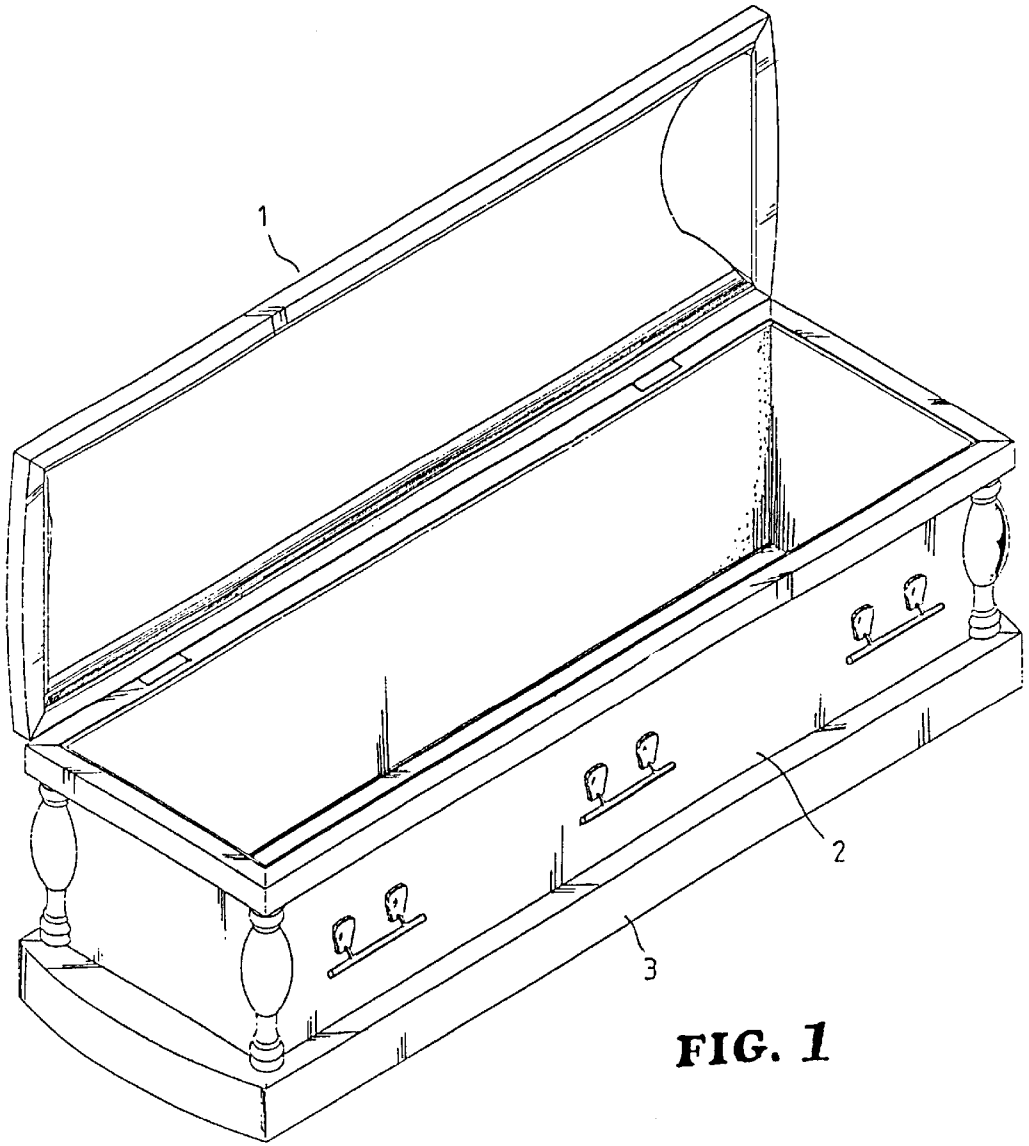
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

The present invention is generally related to an coffin structure, and more particularly to an improved structure of an environmental friendly coffin which is not only inexpensive to manufacture but also reduces the timber material used.

The present invention is directed to an improved structure of an environmental friendly coffin. Referring to FIG. 1, the present invention is shown to comprise a lid 1, a base 2, and a bottom frame 3. The lid 1 is formed by sticking multiple layers of tough kraft and applying thermal pressure thereto utilizing a roller press machine used in paper making so that the layers of kraft form an arched board 10 of kraft boards of a considerable thickness and pressure resistance. Sugar cane boards are used to form L-shaped front and rear end portions 11, 12 to be adhered to front and rear ends of the lid 1 respectively so as to enhance the longitudinal strength of the lid 1 at both ends. They are further nailed to form an integral coffin lid using a stapling gun. Wooden strips 13, 14, 15 and 16 are then fixed to the four sides of the coffin lid.

Figure 2:
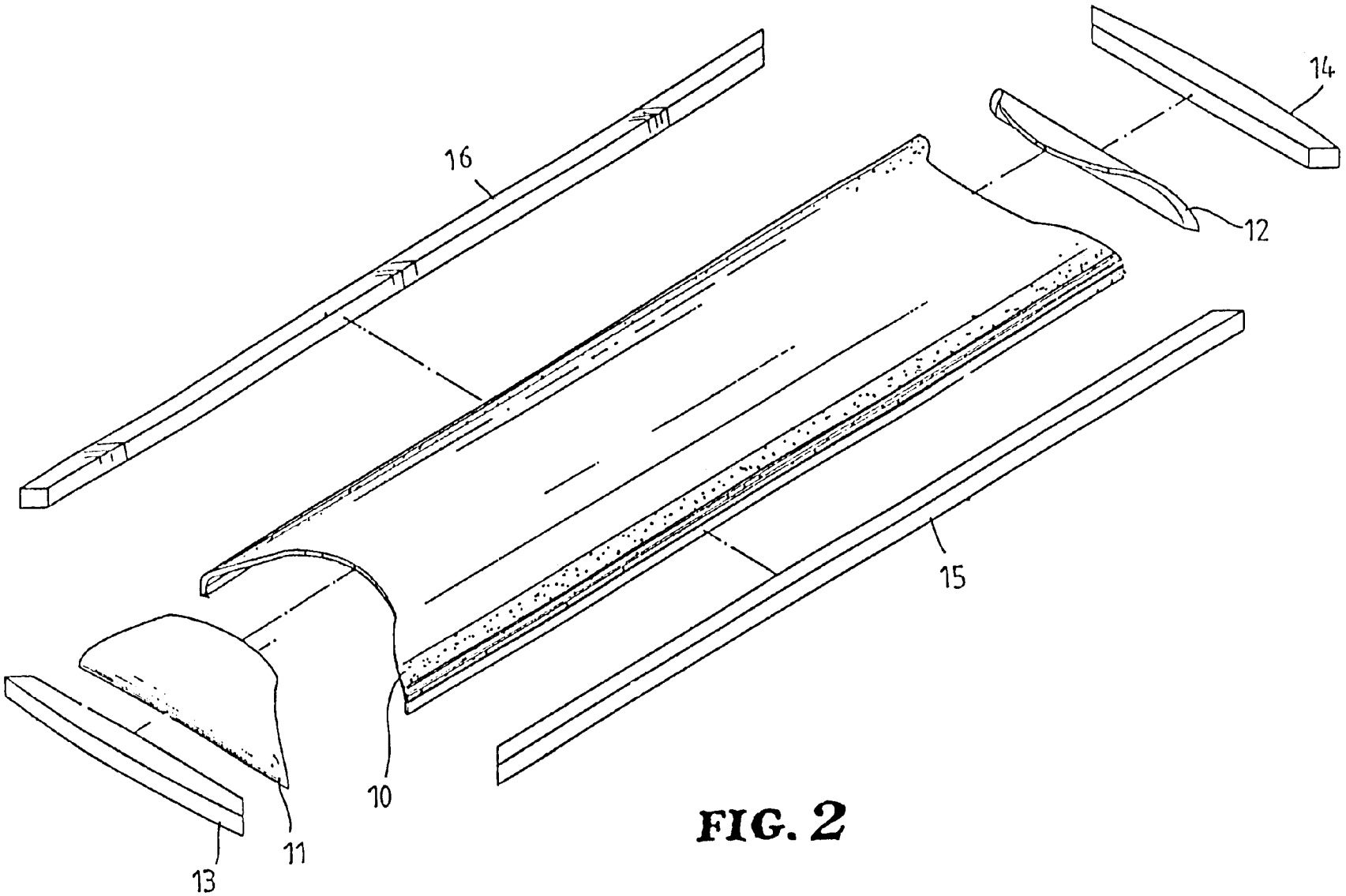
FIG. 2 is a perspective exploded view of the coffin lid according to the present invention.
Figures 3, 3A:
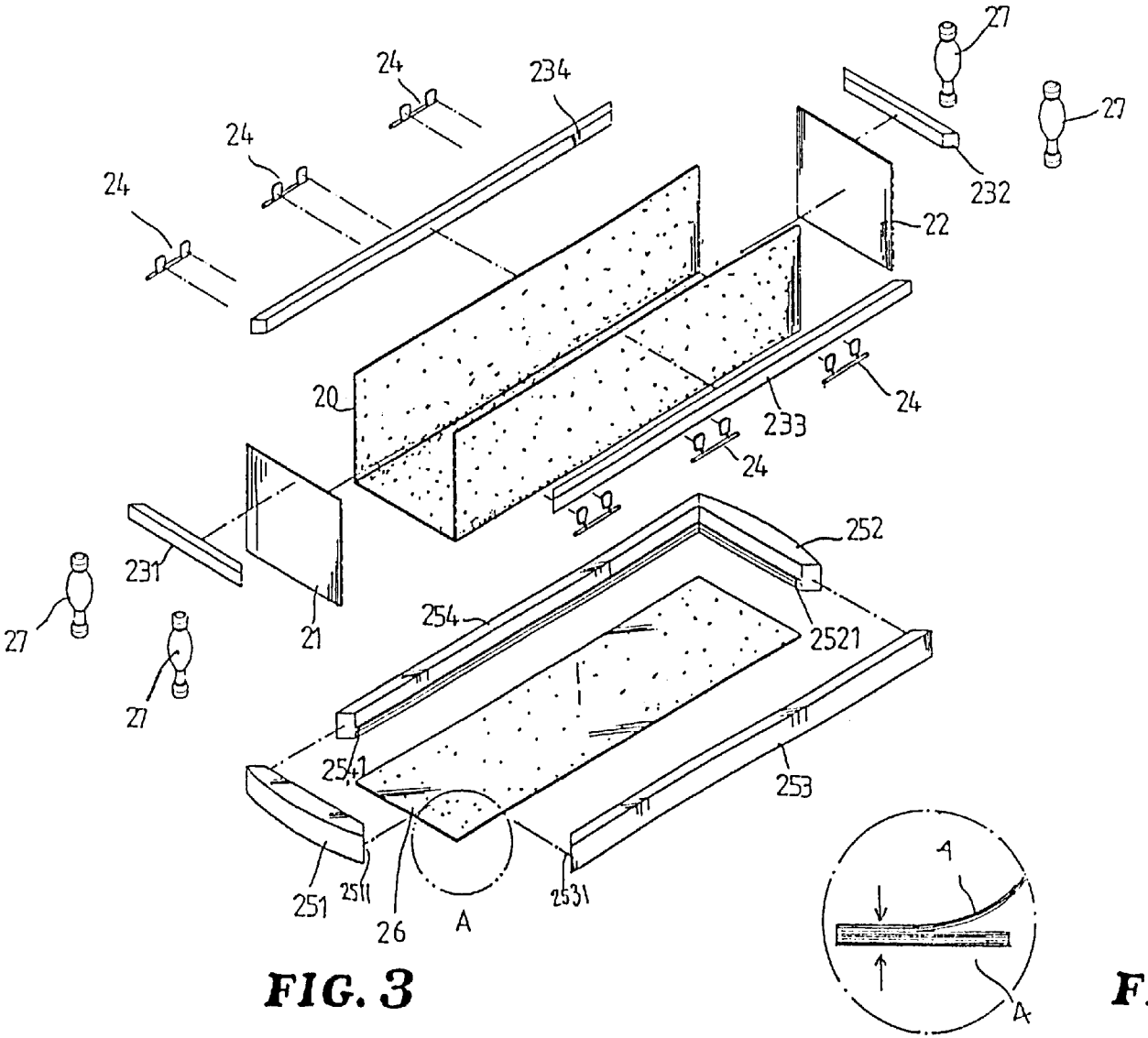
FIG. 3 is a perspective exploded view of the coffin body according to the present invention.
FIG. 3A is an enlarged view of the part "A" in FIG. 3.

Referring to FIGS. 2 and 3, tough kraft boards 4 that have not been cooled from the thermal pressure process are machine-pressed into a U-shaped board 20. Front and rear faceplates 21, 22 are adhered and nailed to front and rear ends of the U-shaped board 20. Four wooden strips 231, 232, 233 and 234 are attached to the two sides of the U-shaped board 20 and also attached to front and rear faceplates 21 and 22.

The U-shaped board 20 is then placed inside a bottom wooden frame consisting of four wooden strips 251, 252, 253 and 254 such that it abuts against respective flanges 2511, 2521, 2531 and 2541 of the bottom wooden frame. A bottom board 26 is attached to a lower side of the flanges 2511, 2521, 2531 and 2541 while the U-shaped board 20 abuts against the opposite side, or upper shoulders, of the flanges.

Lastly, decorative posts 27 are arranged at four sides of the U-shaped board 20. Environmental friendly banana oil of different colors is then used to coat the entire structure to avoid pollution caused by burning the coffin. Hand-grips 24 are additionally installed at both lateral sides of the U-shaped board 20 to facilitate carrying. The kraft boards 4 according to the present invention are tough and strong and may bear a weight of more than a hundred kilograms. Added by the strength of the wooden strips fixed to the four sides of the lid 1 and the four sides of the top portion of the U-shaped board 20, the present invention has good pressure-resistance and shear-resistance.

Figure 4A:
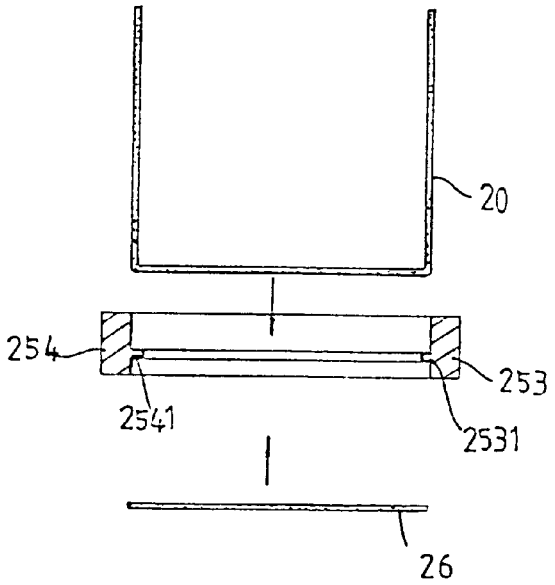
FIGS. 4A, 4B and 4C are schematic views illustrating assembly of the bottom frame according to the present invention.
Figure 4B:
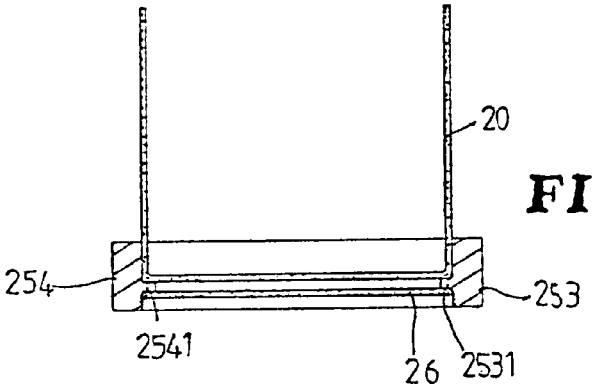
Figure 4C:
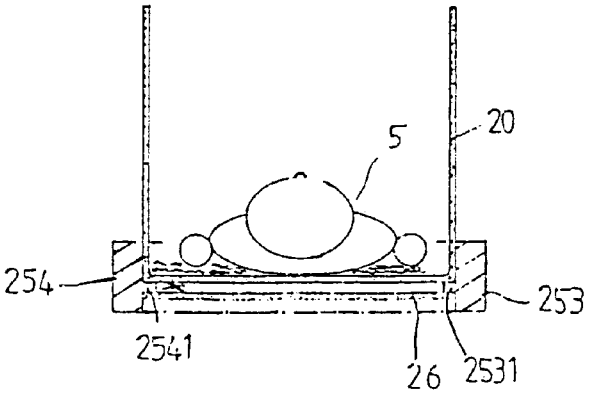

Furthermore, as shown in FIGS. 4A, 4B and 4C, the flanges 2511, 2521, 2531 and 2541 provided at the inner sides of the wooden bottom frame consisting of the wooden strips 251, 252, 253 and 254 constitute a bottom support so that the bottom portion of the U-shaped board has a sufficient bearing force. In addition, a water-resistance PE sheet adhered to a felt sheet may be laid on the inner sides of the coffin. This arrangement, combined with the above-mentioned double-layered bottom frame structure, enhances the leakage-proof characteristic of the coffin.

Figure 5:
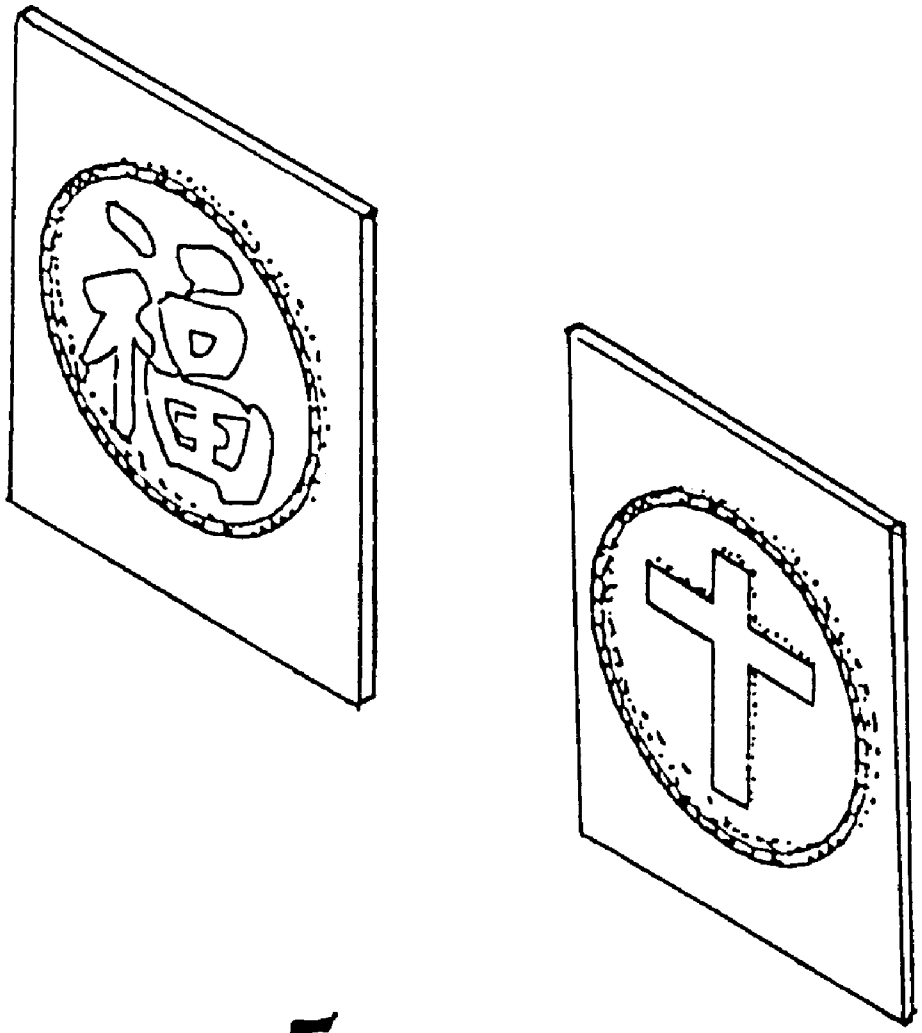
FIG. 5 is a schematic view of an example of the faceplates according to the present invention.

Certainly, the faceplates 21, 22 made from sugar cane boards may be pressed to form religious symbols, patterns and words as needed, as shown in FIG. 5.

In summary, the structural material and design of the present invention are novel, and the present invention vastly improves the bulkiness of conventional coffins while maintaining the pressure-resistance and shear-resistance of the coffin and reducing manufacturing cost. Furthermore, use of kraft boards is environmental friendly and helps conserve timber resources.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. An environmental friendly coffin comprising: a lid, a base, and a bottom wooden frame; the lid adapted to attach to the base and including a lid body, L-shaped front and rear portions attached thereto, and wooden strips fixed to four sides of the lid; the base including a U-shaped board, front and rear faceplates attached thereto, and wooden strips attached to the two sides of the U-shaped board and also attached to the front and rear faceplates; and the bottom wooden frame including four wooden strips having respective flanges with upper shoulders at inner sides thereof, whereby a bottom board is provided on the flanges and the U-shaped board of the base being placed within the bottom frame such that the U-shaped board abuts against the upper shoulders of the flanges.

* * * * *